US005479092A

United States Patent [19]

Pigott et al.

[11] Patent Number: 5,479,092

[45] Date of Patent: Dec. 26, 1995

[54] CURVATURE CORRECTION CIRCUIT FOR A VOLTAGE REFERENCE

[75] Inventors: John M. Pigott, Phoenix; Robert B. Jarrett, Tempe; Byron G. Bynum, Gilbert, all of Ariz.

[73] Assignee: Motorola, Inc., Schaumburg, Ill.

[21] Appl. No.: 388,116

[22] Filed: Feb. 13, 1995

Related U.S. Application Data

[63] Continuation of Ser. No. 112,917, Aug. 30, 1993, abandoned.

[51] Int. Cl.[6] ..... G05F 3/20

[52] U.S. Cl. ..... 323/313; 323/315; 323/907

[58] Field of Search ..... 323/313, 314, 323/315, 316, 907

[56] References Cited

U.S. PATENT DOCUMENTS

| | | | |
|---|---|---|---|
| 4,325,018 | 4/1982 | Schade, Jr. | 323/313 |
| 4,443,753 | 4/1984 | McGlinchey | 323/313 |
| 4,447,784 | 5/1984 | Dobkin | 323/313 X |
| 4,618,816 | 10/1986 | Monticelli | 323/316 |
| 5,220,288 | 6/1993 | Brooks | 323/313 X |

OTHER PUBLICATIONS

Song et al., "A Precision Curvature-Compensated CMOS Bandgap Reference", IEEE Journal of Solid-State Circuits, vol. SC-18, No. 6, Dec. 1983, pp. 634-643.

*Primary Examiner*—Peter S. Wong
*Assistant Examiner*—Y. Jessica Han
*Attorney, Agent, or Firm*—Gary W. Hoshizaki

[57] ABSTRACT

A correction circuit (12) for providing an error correction voltage for a voltage reference (11). The voltage reference (11) provides a reference voltage within a predetermined temperature range. The voltage reference prior to correction has a peak magnitude at a temperature $T_0$ within the predetermined temperature range. A first circuit (13) generates a correction current. Zero current is provided by the first circuit (13) at $T_0$. A second circuit (14) receives the correction current and provides an output current that is unidirectional or of the same sense above and below $T_0$. [Means responsive to t] The output current of the second circuit (14) generates a voltage across a resistor (28) that is [combined] added to the reference voltage above and below $T_0$.

18 Claims, 2 Drawing Sheets

12
11
13
14
15
16
NA
A
KA
A
18
19
21
22
23
24
26
27
28
29
31
32
33
34
36
37
38
39
41
42
43
44
46
47
48
49
51
52
53
54
56

CURVATURE CORRECTION CIRCUIT FOR A VOLTAGE REFERENCE

This application is a continuation of prior application Ser. No. 08/112,917 filed Aug. 30, 1993, now abandoned.

BACKGROUND OF THE INVENTION

This invention relates, in general, to voltage references, and more particularly to correction circuits to reduce error of a voltage reference.

Voltage references provide an accurate and stable voltage over a wide temperature. It is well known that a bandgap reference is easily integrated on existing semiconductor processes and provides an accurate reference voltage that is extremely stable over temperature. The bandgap reference provides a low temperature coefficient (TC) reference voltage by adding two voltages with opposite temperature coefficients, thus canceling the temperature dependence. The resultant voltage produced by the bandgap reference is approximately the bandgap voltage of the semiconductor material. In the case of a silicon semiconductor, the bandgap reference voltage produced is approximately 1.205 volts. The temperature dependence term canceled is generally a first order term or linear term.

Smaller second and third order temperature dependent terms affect the bandgap reference output voltage, although the largest term (linear term) of the temperature dependent terms is canceled. These remaining temperature dependent terms produce an output voltage that graphically looks like an inverted parabola. The peak of the inverted parabola is a point of zero temperature dependence (zero slope) and is typically centered at a center of a temperature range in which the bandgap reference is used. For example, assume the bandgap reference is used over a temperature range of –40 degrees centigrade to 100 degrees centigrade. The zero temperature coefficient point or peak of the inverted parabola is centered at approximately 30 degrees centigrade. Temperatures above and below 30 degrees centigrade will produce an output voltage less than the approximately 1.205 volts produced at 30 degrees centigrade.

Maximum deviations in output voltage of the bandgap reference due to temperature dependencies are small. From the example described above an output voltage deviation of approximately 8 millivolts over the temperature range (–40 to 100 degrees centigrade) can be expected. This small voltage error makes further correction of the bandgap reference extremely difficult. The problem resides in generating a small voltage with an appropriate temperature coefficient centered at the center point of the bandgap reference. Most attempts at compensation start with large voltages or currents that must be reduced or translated appropriately to generate the small correction voltage. Error produced during translation is invariably on the order of the small voltage being generated and thus is not manufacturable or accurate enough to reduce the bandgap reference temperature dependence. It would be of great benefit if an error correction circuit could be produced that is simple to manufacture, inherently produces a small error correction voltage over the usable temperature range of the bandgap reference without translation, and is easily centered with the bandgap center point.

SUMMARY OF THE INVENTION

Briefly stated, this invention provides error correction for a voltage reference. The voltage reference provides a reference voltage to which a correction voltage is added to minimize variations in the reference voltage over a predetermined temperature range.

Correction for the voltage reference is provided by a correction circuit and means responsive to the correction circuit. The correction circuit is responsive to temperature and provides an output signal. The output signal is zero at a predetermined temperature within the predetermined temperature range of the voltage reference. The output signal has a magnitude greater than zero above and below the predetermined temperature. Means responsive to the correction current generates the correction voltage from the output signal.

DETAILED DESCRIPTION OF THE DRAWINGS

Figure 1:
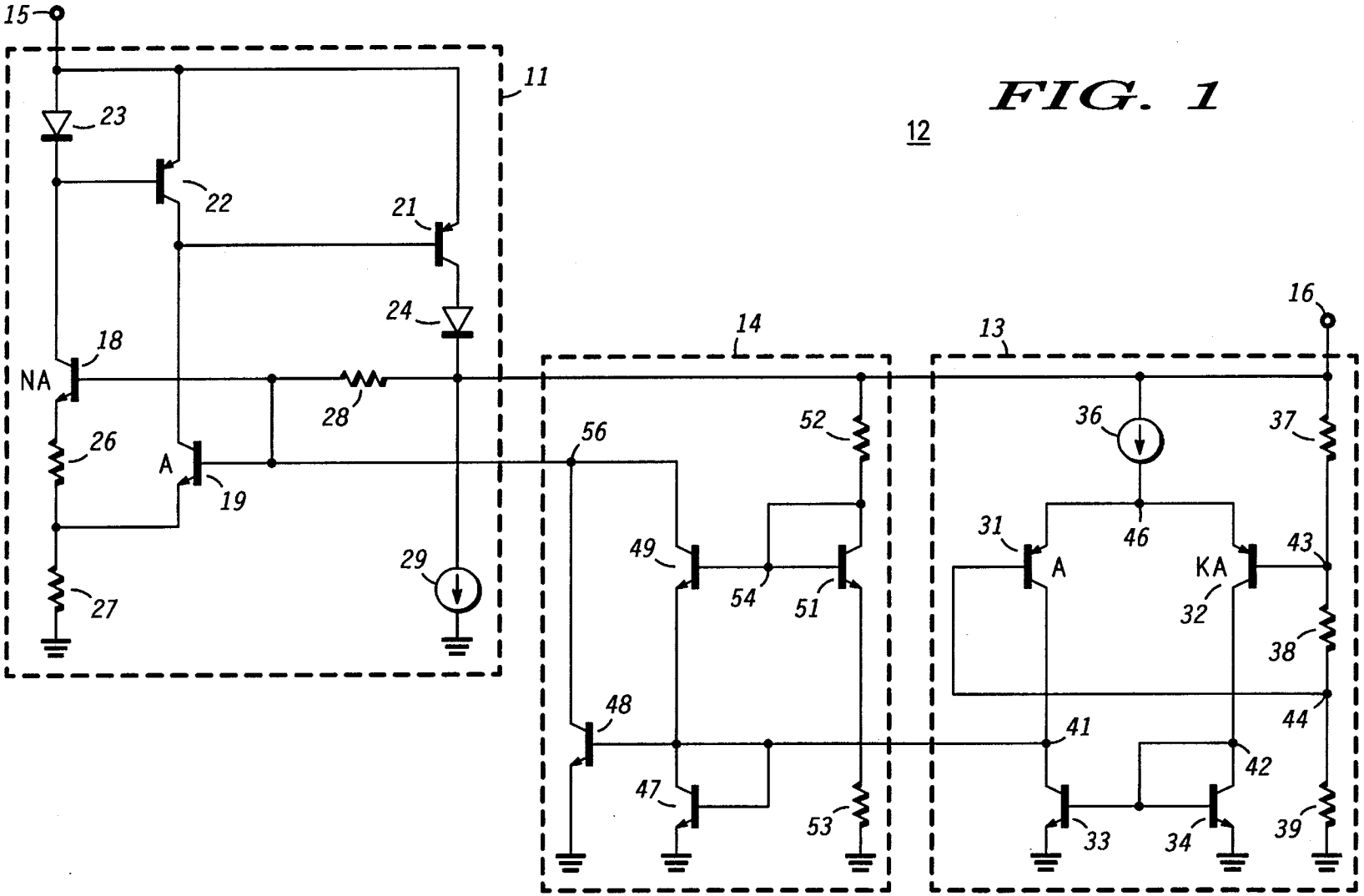
FIG. 1 is a schematic diagram of a correction circuit in accordance with the present invention.

FIG. 1 is a schematic diagram of a voltage reference 11 and a correction circuit 12. Voltage references, in general, provide a reference voltage that is stable over a wide temperature range and varying operating conditions. An example of a common voltage reference used on an integrated circuit is a bandgap voltage reference. The bandgap voltage reference is well known for providing a reference voltage with a low temperature coefficient (TC). The low TC is produced by generating a voltage having a positive temperature coefficient and a voltage with a negative temperature coefficient. The positive and negative TCs negate one another when the voltages are added together producing the low TC reference voltage. Still, not all temperature dependencies are canceled, and the reference voltage varies minutely over temperature. Correcting small voltage, temperature dependent error, can be extremely difficult on a bandgap reference as well as other types of voltage references. Correction circuit 12 reduces temperature dependent error in voltage reference 11 and is easily formed on an integrated circuit in a small area.

In the preferred embodiment, voltage reference 11 is a bandgap voltage reference. A reference voltage is provided at an output 16. Many circuit configurations exist for bandgap voltage references. The circuitry illustrated for voltage reference 11 is for description purposes only. The bandgap voltage reference of voltage reference 11 comprises npn transistors 18, 19, and 21, pnp transistor 22, diodes 23, 24, and resistors 26, 27, and 28.

Diode 23 and pnp transistor 22 receive a bias voltage at input 15 and form a current mirror for providing an identical current I to npn transistors 18 and 19. Npn transistor 18 has an emitter area (NA) that is a predetermined multiple of an emitter area (A) of npn transistor 19. Equilibrium is reached when I*(resistor 26)+Vbe(transistor 18)=Vbe(transistor 19). Resistor 26 affects the current magnitude (I) at which equilibrium occurs. NPN transistor 21 in series with diode 24 provides feedback for driving npn transistors 18 and 19 to the stable condition. Current source 29 biases npn transistor 21 and diode 24. Resistor 27 affects the magnitude of the output voltage at output 16.

Voltage reference 11 has a peak voltage at a predetermined temperature somewhere between the end points of the temperature range in which voltage reference 11 is used. The peak voltage will also correspond to a point having a zero temperature coefficient (TC). In the preferred embodiment, the predetermined temperature of the peak voltage is in the center of the temperature range. Voltage error is minimized across the temperature range by centering the zero TC voltage. The temperature at which zero TC point occurs is determined by the emitter area ratio of npn transistors 18 and 19, and the resistance values of resistors 26 and 27. The reference voltage versus temperature produced by the bandgap voltage reference is well known. The reference voltage is a maximum at the zero TC point and is at a minimum at either end point of the temperature range. Resistor 28 in voltage reference 11 is used to add a correction voltage to the reference voltage provided at output 16. Resistor 28 couples between output 16 and a node 56. The bases of transistors 18 and 19 are also coupled to node 56. No current flows through resistor 28 under ideal conditions (npn transistors 18 and 19 have infinite current gain and no correction voltage is needed) thus no voltage is added by resistor 28 to the reference voltage at output 16.

Correction circuit 12 provides no correction at the zero TC point of voltage reference 11 of the example above. Above and below the zero TC point, correction circuit 12 provides a signal of the same sense that reduces temperature dependent error of voltage reference 11. For example, prior to any voltage correction provided by correction circuit 12, voltage reference 11 has a maximum (or peak) voltage within the predetermined temperature range such that the reference voltage provided by voltage reference 11 is less than the maximum voltage at temperatures above and below the temperature corresponding to the maximum voltage. The maximum voltage occurs at a temperature $T_0$ with the predetermined temperature range. Correction circuit 12 provides a signal (of the same sense) above and below the peak voltage, the signal generates a positive voltage to be summed or combined with the reference voltage for reducing variations in the magnitude of the reference voltage over temperature. It should be obvious that if voltage reference 11 had a minimum voltage instead of a maximum voltage that correction circuit 12 would provide a signal (of the same sense) above and below the temperature corresponding to the minimum voltage which generates a negative voltage for reducing variations in the reference voltage.

In the preferred embodiment, correction circuit 12 comprises a circuit 13 and a circuit 14. Circuit 13 provides a correction signal that can be either a current or voltage signal having an approximately linear temperature coefficient. In the preferred embodiment, circuit 13 provides a correction current. The minimum magnitude of the correction current coincides with the maximum voltage (at $T_0$) produced by voltage reference 11. The magnitude is defined as the absolute value of the correction current. The correction current can be described as two distinct current types, a sink current or a source current. Within the operating temperature range of voltage reference 11, the correction current produced by circuit 13 changes from a sink current to a source current. Circuit 14 receives the correction signal generated by circuit 13 and provides an output signal. The output signal of circuit 14 is unidirectional. In other words, circuit 14 generates an "absolute value" function of the correction signal. For example, circuit 14 converts the correction current described above (from circuit 13) to either a sink current (negative current) or a source current (positive current). In the preferred embodiment, the current magnitude of the correction current of circuit 13 is not changed significantly by circuit 14 when converted to the output current. The output current magnitude of circuit 14 increases approximately linearly as temperature is increased or decreased from $T_0$. The output current produced by circuit 14 is coupled through resistor 28 to produce a correction voltage that reduces voltage error of voltage reference 11 over the operating temperature range.

In the preferred embodiment, circuit 13 provides no current or a minimum magnitude current at the maximum voltage ($T_0$) of voltage reference 11. Circuit 13 also produces the correction current with an approximately linear temperature coefficient having a slope suitable for error correction. Circuit 13 comprises transistors 31–34, a current source 36, and resistors 37–39. The reference voltage provided at output 16 provides a stable and accurate voltage for biasing circuit 13.

In the preferred embodiment, transistors 31 and 32 are pnp transistors (conductivity type) and each has a base, a collector, and an emitter corresponding respectively to a control electrode, a first electrode, and a second electrode. Transistors 31 and 32 form an differential input pair. Transistor 32 has an emitter area (KA—corresponding to a conductive area) some multiple (K) of an emitter area (A—corresponding to a conductive area) of transistor 31. Transistor 31 has the base coupled to a node 44, a collector coupled to a node 41, and an emitter coupled to a node 46. Node 41 corresponds to an output of circuit 14 for providing the correction current. Transistor 32 has the base coupled to a node 43, the collector coupled to a node 42, and the emitter coupled to node 46. Current source 36 biases transistors 31 and 32. Current source 36 has a terminal coupled to output 16 and a terminal coupled to node 46.

A current mirror is formed by transistors 33 and 34. In the preferred embodiment, transistors 33 and 34 are npn transistors (conductivity type) having equal emitter areas (conductive areas) and each has a base, a collector, and an emitter corresponding respectively to a control electrode, a first electrode, and a second electrode. Transistor 34 has the base and collector coupled to node 42, and the emitter coupled to ground. Transistor 33 has the base coupled to node 42, the collector coupled node 41, and the emitter coupled to ground.

A differential input voltage (the voltage drop across resistor 38) is applied across the bases of transistors 31 and 32. In the preferred embodiment the differential input voltage is formed by a resistor divider comprising resistors 37–39. Resistor 37 has a terminal coupled to output 16 and a terminal coupled to node 43. Resistor 38 has a terminal coupled to node 43 and a terminal coupled to node 44, and resistor 38 coupled to node 44 and a terminal coupled to ground.

In the preferred embodiment, operation of circuit 13 provides zero correction current at the maximum voltage ($T_0$) of voltage reference 11. This occurs when the current through transistors 31 and 33 are equal to the current through transistors 32 and 34, thus no output current is provided by circuit 13. For example, voltage reference 11 provides a reference voltage $V_{ref}$ at output 16. The resistor divider is designed such that the voltage drop ($V_d$) .across resistor 38 compensates for the difference in emitter area of transistors 31 and 32 at $T_0$. The required voltage is described by equation 1:

$$V_d(T=T_0)=(kT_{0/q})*ln(K) \quad (1)$$

where q=electron charge, k=Boltzmann's constant, and K=emitter area(transistor 32)/emitter area (transistor 31). The voltage drop across resistor 38 is described by equation 2. R37, R38, and R39 corresponds respectively to the resistor values of resistors 37, 38, and 39.

$$V_d=V_{ref}*(R38/(R37+R38+R39)) \quad (2)$$

The correction current from circuit 13 changes approximately proportionally as the temperature moves in either direction from $T_0$. Bipolar transistors have predictable characteristics which allows accurate placement of the temperature $T_0$. Furthermore, the bandgap voltage reference provides an accurate voltage from which the resistor divider (resistors 37–39) can generate the voltage $V_d$, and the resistor divider is not a function of absolute resistor value, but a ratio of resistor sizes which is easily manufactured on an integrated circuit. Equivalent results could be achieved by ratioing current mirror emitter areas instead of the differential input stage emitter areas.

Circuit 14 changes the correction current of circuit 13 to a unidirectional current. Circuit 14 comprises transistors 47, 48, 49, and 51, and resistors 52 and 53. Like circuit 13, circuit 14 uses the reference voltage provided by voltage reference 11 at output 16. In the preferred embodiment, transistors 47, 48, 49, and 51 are npn transistors (conductivity type) and each has a base, a collector, and an emitter corresponding respectively to a control electrode, a first electrode, and a second electrode. Circuit 14 has an input coupled to node 41 of circuit 13 and an output coupled to node 56.

As mentioned previously, the correction current provided by circuit 13 will change from a source to a sink current over the operating temperature range. In the preferred embodiment, the output current of circuit 14 is a sink current over the operating predetermined temperature range of voltage reference 11. The sink current is coupled to resistor 28 for generating a correction voltage therewith. The voltage generated across resistor 28 is summed or combined with the reference voltage provided by voltage reference 11. Transistor 21 will source the additional current through resistor 28 to circuit 14 to maintain the bandgap reference in the stable condition.

Resistors 52 and 53, and transistor 51 in a diode configuration generate a bias voltage for circuit 14. Resistor 52 has a terminal coupled to output 16 and a terminal coupled to a node 54. Transistor 51 has the base and the collector coupled to node 54. Resistor 53 has a terminal coupled to the emitter of transistor 51 and a terminal coupled to ground. The voltage at node 54 is described by equation 3. R52 and R53 corresponds respectively to the resistor values of resistors 52 and 53. T51 corresponds to transistor 51.

$$V_{node54}=V_{ref}*(R53/(R52+R53))+Vbe(T51) \quad (3)$$

Transistor 47 is in a diode configuration. Transistor 47 has the base and the collector coupled to node 41, and the emitter coupled to ground. Transistor 49 has the base coupled to node 54, the collector coupled to node 56, and the emitter coupled to node 41. Transistor 48 has the base coupled to node 41, the collector coupled to node 56, and the emitter coupled to ground. In the preferred embodiment, the voltage at node 54 is chosen to be, slightly more than a Vbe of a transistor. For example, the voltage at node 54 is at a Vbe+100 millivolts. Biasing circuit 14 as such allows it to operate in two separate modes.

The first mode of operation occurs when circuit 13 sources a current to the bases of transistors 47 and 48. The source current is converted to a sink current by circuit 14. Node 41 is at a voltage of approximately a Vbe under this condition. From the example above, node 54 is at a Vbe+100 millivolts. This leaves a voltage across the base-emitter junction of transistor 49 of approximately 100 millivolts, thus transistor 49 is off. Transistor 48 mirrors the correction current sourced to transistor 47 by circuit 13. The magnitude of the output current generated by transistor 48 can be adjusted by changing the emitter area ratio of transistors 48 and 47. The output current from circuit 14 produces a correction voltage across resistor 28 increasing the reference voltage at output 16.

The second mode of operation occurs when circuit 13 sinks a current to circuit 14. Under this condition node 41 falls to a voltage significantly less than a Vbe. Transistors 47 and 48 are off. Transistor 49 is then enabled and acts similarly to a cascode device for transistor 33 of circuit 13. Transistor 49 generates the output current for circuit 14 which is approximately the correction current provided By circuit 13. The output current from transistor 49 of circuit 14 produces a correction voltage across resistor 28 increasing the reference voltage at output 16. In either the first or second mode of operation, the preferred embodiment of circuit 14 produces the output current having a magnitude similar to the magnitude of the correction current provided by circuit 13.

Figure 2:
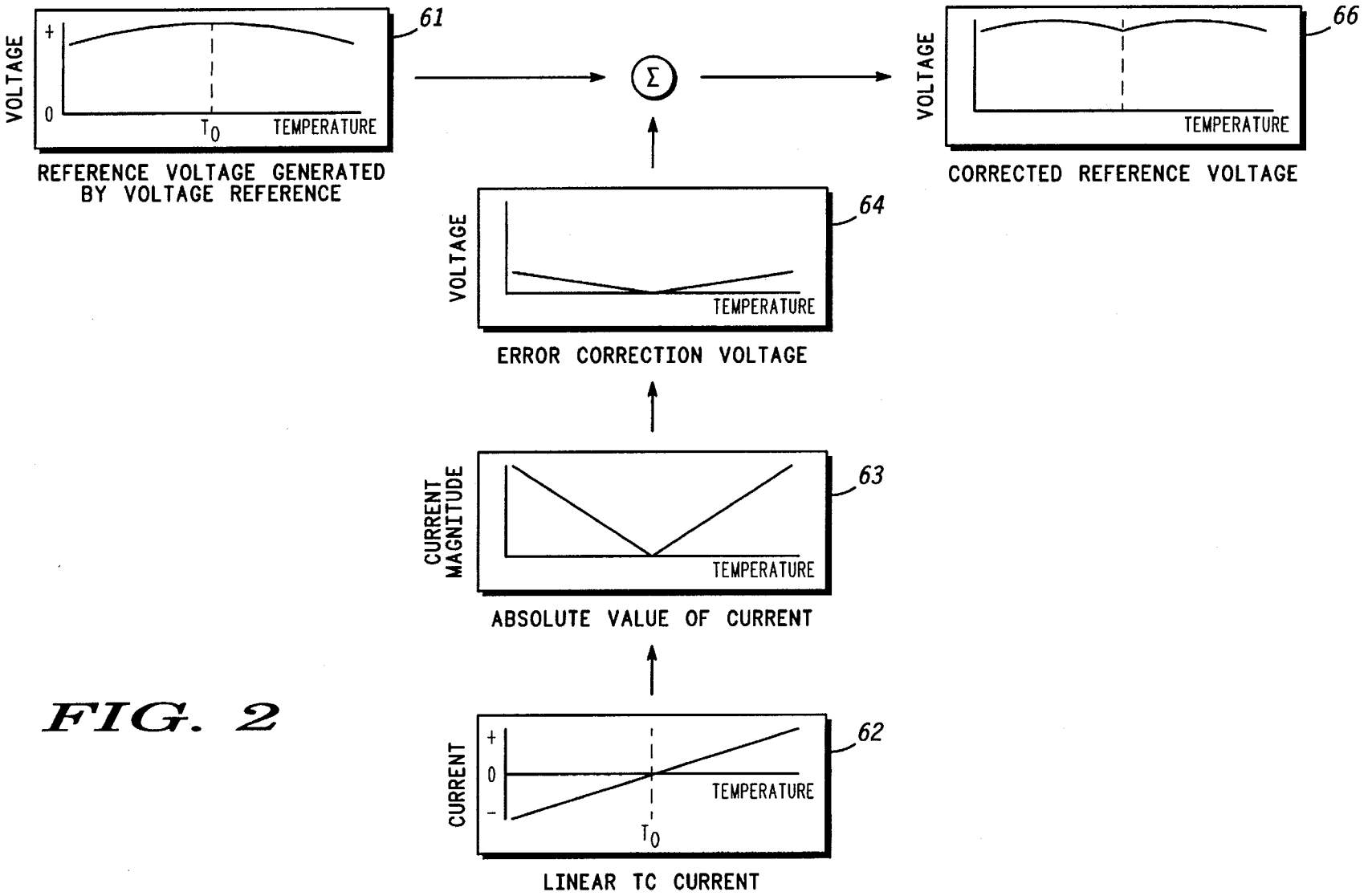
FIG. 2 is a diagram graphically illustrating correction of a reference voltage corresponding to the schematic in FIG. 1.

FIG. 2 is a diagram graphically illustrating error correction of voltage reference 11 (FIG. 1) as provided by correction circuit 12 (FIG. 1). Box 61 illustrates the reference voltage supplied by voltage reference 11. The reference voltage peaks at $T_0$ with the reference voltage falling as temperature increases or decreases from $T_0$. Box 62 illustrates the correction current generated by circuit 13 (FIG. 1) versus temperature. The correction current has an approximately linear temperature coefficient and is centered such that circuit 13 outputs zero current at $T_0$. Circuit 13 provides either a source or sink current as temperature varies from $T_0$. Box 63 illustrates the output current provided by circuit 14 (FIG. 1). The correction current from circuit 13 is converted to a unidirectional output current by circuit 14. Box 64 illustrates a small error correction voltage generated from the output current of circuit 14. The specific method for generating this voltage will be determined by the circuit topology of voltage reference 11. The error correction voltage of box 64 is summed or combined with the reference voltage to yield box 66. Voltage reference 11 in conjunction with correction circuit 12 produces the reference voltage having small deviations over the predetermined temperature range.

Referring back to FIG. 1, correction circuit 12 is easily tested through a single output pad. In the preferred embodiment, either the amount of voltage correction provided by correction circuit 12 is monitored or the output current of circuit 14 is monitored, at a predetermined temperature to determine functionality. Resistor 38 of circuit 13 can be made trimmable to adjust correction circuit 12 precisely. It should be noted that equivalents of circuits 13 and 14 can also be designed with CMOS (complementary metallic oxide semiconductors) or BiCMOS (bipolar and CMOS).

By now it should be appreciated that a correction circuit 12 for a voltage reference 11 has been provided. Correction circuit 12 not only reduces temperature error but is added as a peripheral circuit to voltage reference 11. Correction circuit 12 requires only resistor or transistor matching of components for accuracy which is easily achieved on integrated circuit processes. Voltage correction is "zero based" such that no correction is provided by correction circuit 12 at a predetermined temperature. Testing requires only a single test pad to monitor correction circuit 12 output.

We claim:

1. In a voltage reference circuit for providing a reference voltage over a predetermined temperature range, the reference voltage having a peak voltage within the predetermined temperature range, a correction circuit for reducing the variation in the magnitude of the reference voltage, the correction circuit comprising:

a first circuit for providing a current, said current having an approximately linear temperature coefficient, said first circuit providing a source current at temperatures greater than the peak voltage of the voltage reference circuit and said first circuit providing a sink current at temperatures below the peak voltage of the voltage reference circuit;

a second circuit responsive to said current of said first circuit for providing a correction current, said second circuit converting said current of said first circuit to a uni-directional current; and means responsive to said correction current of said second circuit for generating a correction voltage to the voltage reference circuit.

2. A circuit as recited in claim 1 wherein said first circuit comprises:

a differential transistor pair responsive to a differential voltage wherein an area of a first transistor is less than an area of a second transistor of said differential transistor pair; and a current mirror circuit coupled to said differential transistor pair, said first circuit providing no current at approximately the peak voltage within the predetermined voltage range.

3. A circuit as recited in claim 2 wherein said first circuit and said second circuit are biased by the voltage reference circuit.

4. A circuit as recited in claim 2 wherein said second circuit comprises:

a first transistor including a control electrode for receiving a bias voltage, a first electrode coupled to an output of said second circuit, and a second electrode coupled to an input of said second circuit for receiving said current of said first circuit;

a second transistor including a control electrode and a first electrode coupled to said input of said second circuit, and a second electrode coupled to a terminal of a first power supply; and a third transistor including a control electrode coupled to said input of said second circuit, a first electrode coupled to said output of said second circuit, and a second electrode coupled to said terminal of said first power supply.

5. A circuit as recited in claim 1 wherein the voltage reference circuit is a bandgap voltage reference.

6. A circuit as recited in claim 1 wherein said first circuit comprises:

said first transistor of a first conductivity type including a control electrode, a first electrode coupled to an output of said first circuit, and a second electrode;

said second transistor of said first conductivity type including a control electrode, a first electrode, and a second electrode coupled to said second electrode of said first transistor, said differential voltage being applied across said control electrodes of said first and second transistors wherein said first and second transistors form said differential transistor pair;

a current source for biasing said first and second transistors, said current source having a terminal coupled to a terminal of a first power supply, and a second terminal coupled to said second electrode of said first transistor;

a third transistor of a second conductivity type including a control electrode and a first electrode coupled to said first electrode of said second transistor, and a second electrode coupled to a terminal of a second power supply; and a fourth transistor of said second conductivity type including a control electrode coupled to said first electrode of said second transistor, a first electrode coupled to said output of said first circuit, and a second electrode coupled to said terminal of said second power supply wherein said third and fourth transistors form said current mirror circuit.

7. A circuit as recited in claim 6 wherein said second transistor has a conductive area a multiple of a conductive area of said first transistor.

8. A circuit as recited in claim 7 further including a first resistor coupled between said terminal of said first power supply and said control electrode of said second transistor;

a second resistor coupled between said control electrode of said first transistor and said control electrode of said second transistor; and a third resistor coupled between said control electrode of said first transistor and said terminal of said second power supply, said first, second, and third resistors forming a resistor divider for providing said differential voltage.

9. A circuit as recited in claim 8 wherein said second resistor is trimmable to adjust said first circuit to provide a zero correction signal at a predetermined temperature.

10. In a voltage reference circuit for providing a reference voltage over a predetermined temperature range, the reference voltage varying within the predetermined temperature range, a circuit for reducing the variation in the magnitude of the reference voltage, the circuit comprising:

a correction circuit means responsive to temperature for providing an output signal, said output signal being approximately zero at a predetermined temperature within the predetermined temperature range and said output signal having a value other than zero, but of the same sense, above and below said predetermined temperature within the predetermined temperature range;

means responsive to said correction circuit means for producing a correction voltage over the predetermined temperature range, said correction voltage being combined with the reference voltage to reduce variations in the magnitude therein over the predetermined temperature range;

a first circuit producing a correction signal having a minimum magnitude at the predetermined temperature;

a second circuit means responsive to said correction signal for providing said output signal, said output signal being uni-directional over the predetermined temperature range of the voltage reference circuit;

a first transistor including a control electrode for receiving a bias voltage, a first electrode coupled to an output for providing said output signal of said second circuit means, and a second electrode coupled to an input of said second circuit means for receiving said correction signal;

a second transistor including a control electrode and a first electrode coupled to said input of said second circuit means, and a second electrode coupled to a terminal of a first power supply;

a third transistor including a control electrode coupled to said input of said second circuit means, a first electrode coupled to said output of said second circuit means, and a second electrode coupled to said terminal of said first power supply;

a fourth transistor including a control electrode and a first electrode coupled to said control electrode of said first transistor, and a second electrode;

a first resistor coupled between a terminal of a second power supply and said control electrode of said first transistor; and a second resistor coupled between said second electrode of said fourth transistor and said terminal of said first power supply, said fourth transistor, first resistor, and second resistor generating said bias voltage.

11. A circuit as recited in claim 10 wherein said bias voltage is not of sufficient voltage magnitude to enable said first, second, and third transistors.

12. A voltage reference circuit for providing a reference voltage within a predetermined temperature range, the voltage reference circuit comprising:

a bandgap reference circuit for providing an output voltage, said output voltage being a maximum at a predetermined temperature within the predetermined temperature range;

a first circuit providing a correction current that varies linearly with temperature, said correction current having an approximately constant temperature coefficient over the predetermined temperature range and wherein the magnitude of said correction current being a minimum at said predetermined temperature;

a second circuit means responsive to said correction current for providing an output current, said output current being uni-directional over said predetermined temperature range;

means responsive to said second circuit means for producing a correction voltage over said predetermined temperature range, said correction voltage being added to said output voltage of said bandgap reference to generate the reference voltage.

13. A voltage reference circuit as recited in claim 12 wherein said correction current provided by said first circuit is approximately zero at the predetermined temperature.

14. A voltage reference circuit as recited in claim 12 wherein said first circuit and said second circuit means are biased by said bandgap reference circuit.

15. A circuit for providing a correction signal to a voltage reference, the voltage reference providing a reference voltage over a predetermined temperature range, the circuit comprising:

a first circuit having an output for providing a correction current, said first circuit comprising:

a first transistor of a first conductivity type including a control electrode, a first electrode coupled to said output of said first circuit, and a second electrode;

a second transistor of said first conductivity type including a control electrode, a first electrode, and a second electrode coupled to said second electrode of said first transistor, a differential input voltage being applied across said control electrodes of said first and second transistors;

a current source for biasing said first and second transistors, said current source having a terminal coupled to a terminal of a first power supply, and a second terminal coupled to said second electrode of said first transistor;

a third transistor of a second conductivity type including a control electrode and a first electrode coupled to said first electrode of said second transistor, and a second electrode coupled to a terminal of a second power supply; and a fourth transistor of said second conductivity type including a control electrode coupled to said first electrode of said second transistor, a first electrode coupled to said output of said first circuit, and a second electrode coupled to said terminal of said second power supply;

a second circuit means having an input for receiving said correction current and an output for providing an output current, said second circuit means comprising:

a fifth transistor of said second conductivity type including a control electrode for receiving a bias voltage, a first electrode coupled to said output of said second circuit means, and a second electrode coupled to said input of said second circuit means;

a sixth transistor of said second conductivity type including a control electrode and a first electrode coupled to said input of said second circuit means, and a second electrode coupled to said terminal of said second power supply; and a seventh transistor of said second conductivity type including a control electrode coupled to said input of said second circuit means, a first electrode coupled to said output of said second circuit means, and a second electrode coupled to said terminal of said second power supply; and means responsive to said second circuit means for producing a correction voltage over the predetermined temperature range, said correction voltage being combined with the reference voltage of the voltage reference.

16. A circuit for providing a correction signal to a voltage reference, the voltage reference providing a reference voltage over a predetermined temperature range, the circuit comprising:

a first circuit having an output for providing a correction current, said first circuit comprising:

a first transistor of a first conductivity type including a control electrode, a first electrode coupled to said output of said first circuit, and a second electrode;

a second transistor of said first conductivity type including a control electrode, a first electrode, and a second electrode coupled to said second electrode of said first transistor a differential input voltage being applied across said control electrodes of said first and second transistors;

a current source for biasing said first and second transistors, said current source having a terminal coupled to a terminal of a first power supply, and a second terminal coupled to said second electrode of said first transistor;

a third transistor of a second conductivity type including a control electrode and a first electrode coupled to said first electrode of said second transistor, and a second electrode coupled to a terminal of a second power supply; and a fourth transistor of said second conductivity type including a control electrode coupled to Said first electrode of said second transistor, a first electrode coupled to said output of said first circuit, and a second electrode coupled to said terminal of said second power supply;

a second circuit means having an input for receiving said correction current and an output for providing an output current, said second circuit means comprising:

a fifth transistor of said second conductivity type including a control electrode for receiving a bias voltage, a first electrode coupled to said output of said second circuit means, and a second electrode coupled to said input of said second circuit means;

a sixth transistor of said second conductivity type including a control electrode and a first electrode coupled to said input of said second circuit means, and a second electrode coupled to said terminal of said second power supply; and a seventh transistor of said second conductivity type including a control electrode coupled to said input of said second circuit means, a first electrode coupled to said output of said second circuit means and a second electrode coupled to said terminal of said second power supply;

means responsive to said second circuit means for producing a correction voltage over the predetermined temperature range, said correction voltage being combined with the reference voltage of the voltage reference;

a first resistor coupled between said terminal of said first power supply and said control electrode of said second transistor;

a second resistor coupled between said control electrode of said first transistor and said control electrode of said second transistor;

a third resistor coupled between said control electrode of said first transistor and said terminal of said second power supply, said first, second, and third resistors forming a resistor divider for generating said differential input voltage;

an eighth transistor of said second conductivity type including a control electrode and a first electrode coupling to said control electrode of said fifth transistor, and a second electrode;

a fourth resistor coupled between said first terminal of said first power supply and said control electrode of said fifth transistor; and a fifth resistor coupled between said second electrode of said eighth transistor and said terminal of said second power supply, said eighth transistor, fourth resistor, and fifth resistor generating said bias voltage.

17. A circuit as recited in claim 16 wherein said second transistor has a conductive area some multiple of a conductive area of said first transistor.

18. A circuit as recited in claim 17 wherein said second resistor is made trimmable to adjust said output current of said second circuit means with respect to temperature.

* * * * *